United States Patent [19]

Arya

[11] 4,327,806

[45] May 4, 1982

[54] OFFSET DRIVER ACCESSORY

[75] Inventor: Satya P. Arya, Somerville, N.J.

[73] Assignee: Ingersoll-Rand Company, Woodcliffe Lake, N.J.

[21] Appl. No.: 84,668

[22] Filed: Oct. 15, 1979

[51] Int. Cl.[3] ..... E21D 20/00; B25D 17/00

[52] U.S. Cl. ..... 173/131; 173/132

[58] Field of Search ..... 173/128, 131, 132, 129; 145/30 R

[56] References Cited

U.S. PATENT DOCUMENTS

| | | | |
|---|---|---|---|
| 352,756 | 11/1886 | Husted | 173/131 X |
| 667,464 | 2/1901 | Seeger et al. | 173/131 X |
| 1,566,631 | 12/1925 | Sturtevant | 173/131 X |
| 2,605,808 | 8/1952 | Current | 173/131 X |
| 2,944,523 | 7/1960 | Werstein | 173/131 X |
| 3,454,113 | 7/1969 | Holtz | 173/129 |
| 3,499,497 | 3/1970 | Moore | 173/129 |
| 3,699,799 | 10/1972 | Paine | 173/131 X |
| 3,922,867 | 12/1975 | Scott | 85/85 |

FOREIGN PATENT DOCUMENTS

| | | | |
|---|---|---|---|
| 582387 | 11/1977 | U.S.S.R. | 173/131 |

*Primary Examiner*—Wm. Carter Reynolds

*Attorney, Agent, or Firm*—David W. Tibbott; Bernard J. Murphy

[57] ABSTRACT

The invention comprises an Accessory for use with a driver for forceably inserting friction rock stabilizers into bores formed in earth structures (such as mine roofs). In the depicted embodiments, the Accessory comprises an elongate body having a pin or socket at one, "lower", "driven" end for engaging and supporting an end of a stabilizer, and a limb or socket at the opposite, "upper", "drive" end for receiving a driver. The latter limb or socket is offset, to accommodate an angled, unobstructed address of the driver to the upper end of the body, and to enable a linear insertion of a lower-end-supported stabilizer into a bore. In accommodating a driver at the upper end of the body, to forceably insert a stabilizer which has its termination supported on the lower end of the body (the insertion force, therefore, being applied through the body), the Accessory facilitates bore insertion of lengthy stabilizers, by means of conventional drivers, in low headroom, subterranean openings.

5 Claims, 7 Drawing Figures

OFFSET DRIVER ACCESSORY

In recent years, friction rock stabilizers, particularly those sold under the trademark "Split Set", by Ingersoll-Rand Equipment Corporation, have become quite popular for stabilizing or anchoring metal mine roofs. These stabilizers are manufactured in the form of split tubes, varying in length from three feet to eight feet, and are exemplified by the U.S. Pat. No. 3,922,867, issued Dec. 2, 1975, to James J. Scott, for "Friction Rock Stabilizer". Pneumatic insertion tools like jackdrills and stopers are frequently used for installation of these stabilizers.

Jackdrills and stopers have a minimum working height of about five feet. Accordingly, in low headroom mines (as low as 5'-0"), friction rock stabilizers cannot be installed, directly, with standard jackdrills or stopers. A special tool or accessory is required which, when used with conventional drivers (such as jackdrills or stopers), will enable the insertion of the stabilizers into low headroom mine roofs or the like.

It is an object of this invention to provide the required tool or accessory. Particularly it is an object of this invention to set forth an offset, driver accessory, for inserting friction rock stabilizers in earth bores, comprising an elongate body; means at one end of said body for engaging an end of a friction rock stabilizer; and means at the opposite end of said body for receiving a driver tool; wherein said body and said receiving means have centerline axes which define an acute angle therebetween. It is also an object of this invention to provide an offset, driver accessory, for inserting longitudinally slit rock stabilizers in earth boxes, comprising an elongate body; means at one end of said body for engaging an end of a friction rock stabilizer; and means at the opposite end of said body for receiving a driver tool; wherein said body and said receiving means have centerline axes which define an acute angle therebetween; said body comprises means for providing lateral, contacting support to a friction rock stabilizer upon such being engaged with said engaging means thereof; and said support-providing means comprises key means (1) for laterally engaging the longitudinal slit of a friction rock stabilizer and (2) for slidably guiding the latter during earth bore insertion thereof.

Further objects of this invention, as well as the novel features thereof, will become more apparent by reference to the following description taken in conjunction with the accompanying figures, in which.

Figure 1:
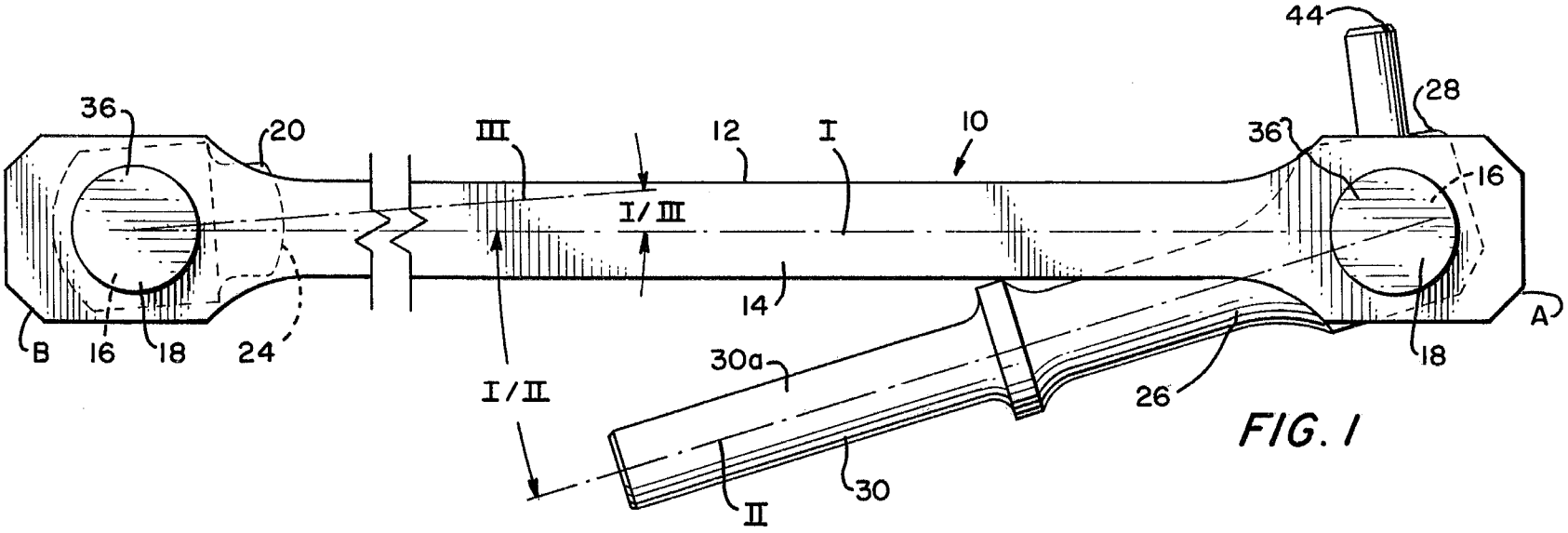
FIG. 1 is a discontinuous, side elevational view of an embodiment of the invention.
Figure 2:
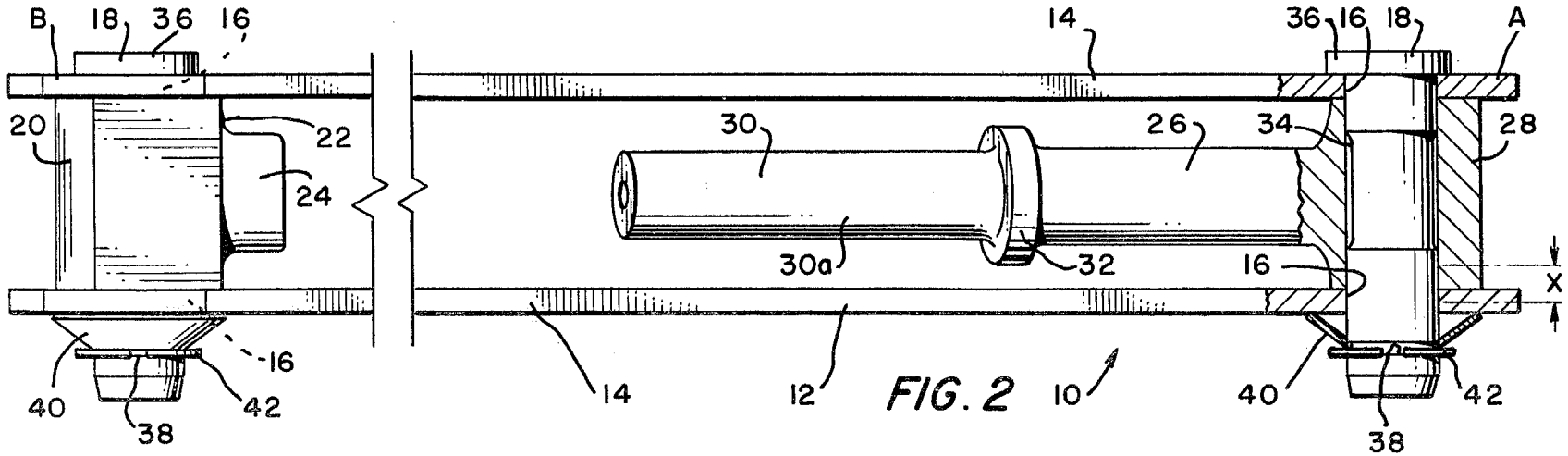
FIG. 2 is a discontinuous, front elevational view, partly cross-sectioned, of the FIG. 1 embodiment.
Figure 3:
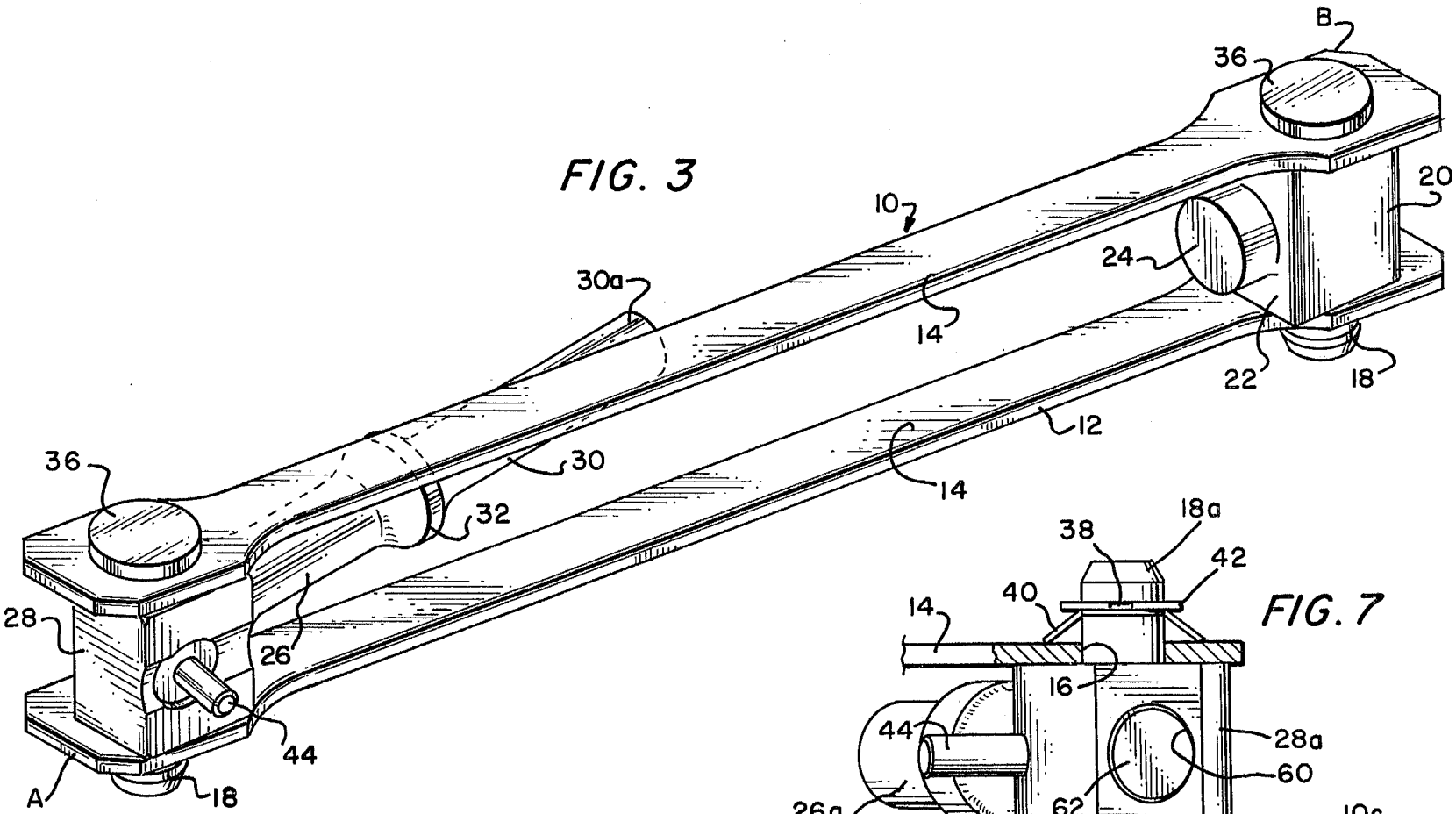
FIG. 3 is an isometric projection of the FIG. 1 embodiment.

As shown in FIGS. 1 through 3, an offset, driver accessory 10, according to a first embodiment thereof, comprises a rigid body 12 formed of a pair of parallel, matching bars 14 of a given length. As shown in FIG. 2, bars 14 are straight from end to end thereof. Due to the directly-engaged mechanical connection of drivers 20 and 26 with bars 14, through the studs 18, insertion forces addressed to the tool-receiving, pivot driver 26 are directly communicated to the bars 14 and, therethrough, directly to the stabilizer-engaging driver 20. Opposite ends of the bars 14 have bolt apertures 16 formed therein to receive studs 18 therethrough.

The body 12 has a "drive" end A and a "driven" end B, the two being so identified in that end A is configured to receive an insertion tool—such as one of the aforesaid jackdrills or stopers, or the like—to impart friction rock stabilizer insertion or "drive" forces thereto; end B, however, is configured to engage an end of a friction rock stabilizer for communicating thereto the aforesaid forces (to cause the stabilizer to be "driven" into an earth bore).

The stud 18, which bridges between bars 14 at end B mounts a stabilizer driver 20 thereat. The driver 20, of a length less than that of bars 14, has a flat, generally-rectangular land 22 and, from centrally of the latter, there projects a prominent, short stub 24. Stub 24 engages the inside diameter of a friction rock stabilizer, the end of the latter being received on the land 22.

The other stud 18, at end A, mounts a tool driver 26. Driver 26, also of a length less than that of bars 14, comprises a centrally bored head 28 from which there extends an elongate rod 30. Intermediate the ends of rod 30 there is formed an enlarged annulus 32. The pendant end 30*a* of rod 30 defines a receiver for a stabilizer insertion tool, and the annulus 32 comprises a limit stop for the tool. Drivers 20 and 26 can be pivoted, to desired angulations relative to bars 14, by means of strong manual force applied thereto, or by tapping the stub 24 or rod 30, lightly, with a hammer or mallet.

The cut-away or partially cross-sectional view at end A shown in FIG. 2 is common to end B as well, as concerns the mating relationship between the stud 18 and its related driver 26 (and the other stud 18 and its related driver 20). That is, each stud 18 has a relief 34 formed therein, intermediate the ends thereof, to cause "drive" and "driven" forces to be impressed only on the ends thereof—in proximate adjacency to the bars 14. This expedient restricts the bending moment to very short spans (of which dimension "X" is representative) between the bearing surfaces of the studs 18 and the bars 14.

Each stud 18 has a head 36 at one end and a snap ring groove 38 adjacent the end opposite. A belleville-type washer 40 is fitted about the opposite end of each stud 18, the washer 40 being secured in place by a snap ring 42 which nests in the groove 38. Accordingly, replacement of driver 20 or 26 (or bars 14) is facilely accommodated.

Body 12 has a centerline axis "I" and, in operating disposition (as shown) the tool driver 26 has a centerline axis "II" which is acutely, angularly offset from axis "I". The offset angle "I/II" is approximately fifteen degrees of arc, and allows for a close-in engagement of an insertion tool with the driver 26.

Driver 20 also has a centerline axis "III" offset at an acute angle "I/III" and this allows the stabilizer to lie alongside the drive end A for, and during, borehole insertion; it also accommodates for side-loading of stabilizers onto the accessory 10.

The more common form of friction rock stabilizer has an axially-extending slit formed in the wall thereof. To accommodate such slit, and more surely to guide the stabilizer during its driven insertion, the novel accessory 10 carries a stabilizer-slit key 44. Key 44 extends outwardly, from the head 28 of driver 26, normal to the axis of stud 18 thereat and substantially normal to the centerline axis "III" of driver 20. Key 44 engages the slit in the stabilizer, to guide the latter, as aforesaid; the head 28 defines a bearing surface for receiving thereon one side of the stabilizer, and providing lateral support thereto.

The accessory 10 is convenient to use and installs stabilizers satisfactorily when used with jackdrills, stopers or similar equipment. It transmits impact energy efficiently to the stabilizer because of its low weight and, as is explained in the ensuing text, special positioning of load transfer points. The low weight of the accessory was achieved by reducing the bending moments to one tenth, compared to prior, known designs. As noted, studs 18 are both undercut to position the loading close to the parallel bars 14. The stabilizer can be emplaced from the side of the accessory 10, resulting in quick engagement and reduced installation time. The accessory 10 is of weldfree construction; all parts can be assembled or disassembled readily, and worn out components can be replaced readily. It is much lighter in weight as compared to other units; it weighs about 12 lbs. It is made out of commercially available, heat treatable, alloy steels. The accessory 10 is of simple and economical design and can be produced by ordinary machine shops. Expected life of the unit is appreciable.

This embodiment has been favorably tested to an equivalent of one thousand stabilizer insertions, and is now being tested in the field. Accessory 10 can transmit up to about one hundred ft-lb of impact energy per blow, satisfactorily, and can be built to larger dimensions, with same configurations, to work with large machines like Jumbos.

Figure 4:
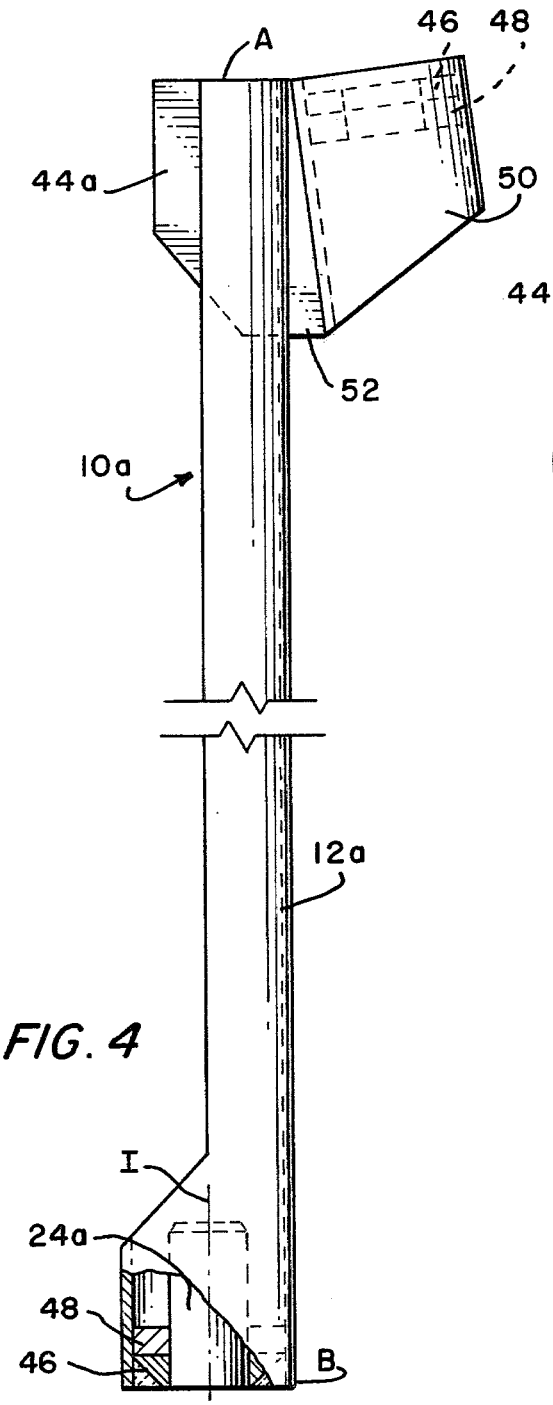
FIG. 4 is a discontinuous, partly cross-sectioned, side elevational view of an alternative embodiment of the invention.

An alternative accessory embodiment 10*a*, according to the invention, is shown in FIG. 4. Basically, this embodiment is formed from stock tubing and, notwithstanding the differences in design between embodiments 10 and 10*a*, same or similar index numbers denote same or similar structures. Also, the Roman numeral "I", again, denotes the centerline axis of the body 12*a*. The body 12*a* of accessory 10*a* is formed of tubing, as noted, in which a substantial portion thereof—on the left (as viewed in FIG. 4), stabilizer entry side—is cut away. Accordingly, that portion of the body defines a sort of cove in which to nest the stabilizer. The driven end B retains the full wall of the tubing and mounts centrally therein a stub or dowel 24*a*. As can be seen, this stabilizer-engaging stub or dowel 24*a* has a centerline axis in common with the centerline axis "I" of the body 12*a*. Dowel 24*a* is secured by a ring 46, by welds, and is further rigidized by a ring-surmounting, annular insert 48. Insert 48 and end B of the tubing define a cup-shaped receiver for the end of the stabilizer; as with stub 24 of embodiment 10 (FIGS. 1–3), dowel 24*a* engages the i.d. of the stabilizer.

Another cup-shaped receiver 50, also having a welded in place ring 46 and surmounting insert 48, is welded to end A of body 12*a*, at an offset angle, by means of an interpositioned wedge 52. Receiver 50, of course, accommodates therein the working end of an insertion tool. A thin, flat key 44*a* projects from the "cove" of end A to guidably engage the slit of a friction rock stabilizer.

Figure 6:
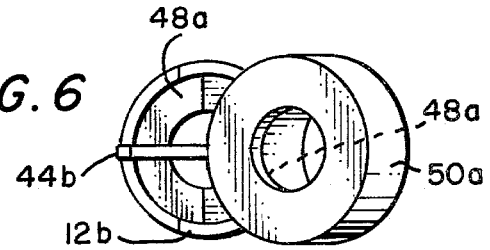
FIG. 6 is a top or plan view of the embodiment of FIG. 5.
Figure 5:
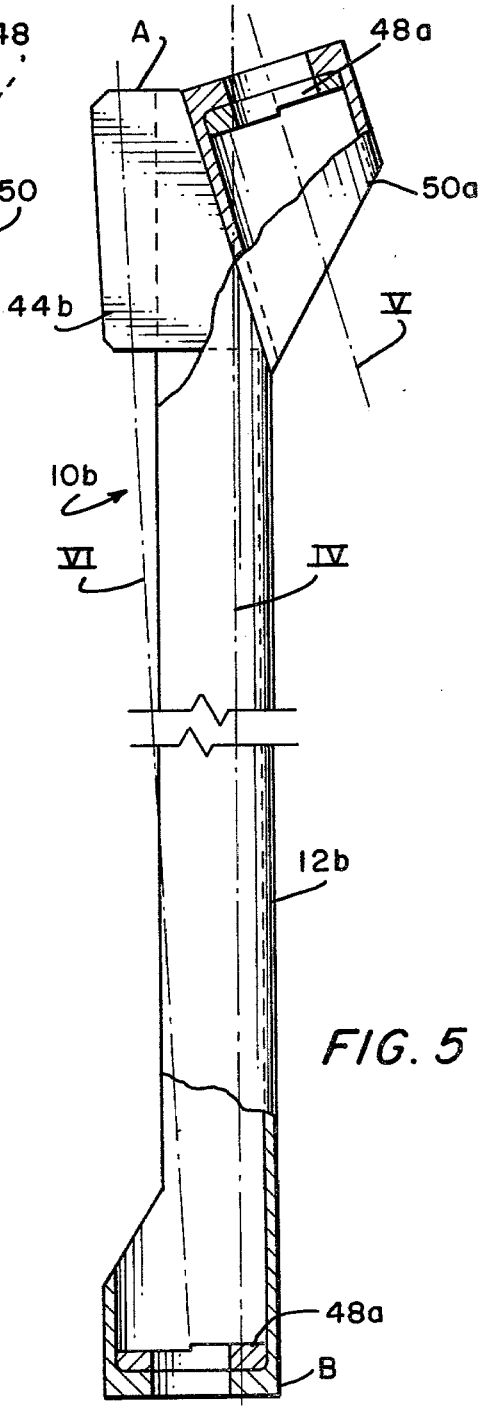
FIG. 5 is a discontinuous, partly cross-sectioned, side elevational view of yet a further alternative embodiment of the invention.

Yet a further accessory embodiment 10*b* is shown in FIGS. 5 and 6. In this embodiment means are provided to transfer to or impose loading on the neutral axis thereof. Otherwise, it is quite similar to embodiment 10*a*, having a body 12*b* formed substantially of half tubing. The neutral axis "IV" bisects the centerline axis "V" of the installation tool (not shown), which is received in the cup-shaped receiver 50*a*, beyond the image area of FIG. 5. More, however, receiver 50*a* has a one-piece, stepped insert 48*a* which causes the tool forces to be addressed along the neutral axis IV; the innermost, thicker-step portion of the insert 48*a*, which "bottoms" the tool, is traversed by the neutral axis "IV".

Similarly, end B of body 10*b* has another one-piece, stepped insert 48*a*, the thicker, stabilizer-end engaging portion of which is traversed by the neutral axis "IV".

By these means, bending moments are substantially eliminated.

Axis "VI" defines the centerline of the stabilizer and, as can be seen, is parallel with the outermost edge of the key 44*b*.

Figure 7:
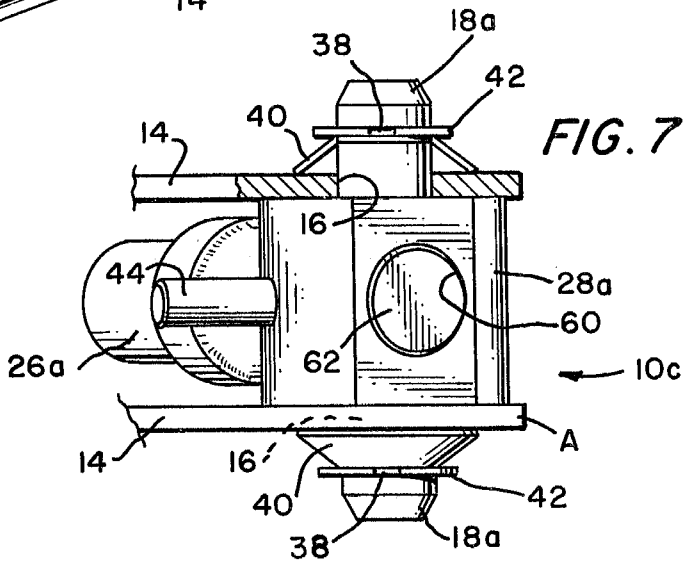
FIG. 7 is a fragmentary view, partially cross-sectioned, of the drive end of a further alternative embodiment of the invention illustrative of the slidably replaceable driver.

The further, alternative embodiment 10*c*, in FIG. 7, is similar to embodiment 10, having bars 14 and a driven end like that of end B of embodiment 10. The drive end A, however, is differently constructed to accommodate replaceable drivers—such as driver 26*a*. In this embodiment a header 28*a*, which has oppositely-extending pivot limbs 18*a* integral therewith, is pivotably received in apertures 16 formed in bars 14. The limbs 18*a* have grooves 38 formed therein to receive snap rings 42 therein to constrain belleville-type washers 40 against the bars 14—the washers 40, of course, securing the header 28*a* in place. Header 28*a* has a radial borehole 60 formed therein for replaceably receiving therein a mating shank end 62 of a driver 26*a*.

While I have described my invention in connection with specific embodiments thereof, it is to be clearly understood that this is done only by way of example, and not as a limitation of the scope of the invention as set forth in the objects thereof and in the appended claims.

I claim:

1. An offset driver accessory, for inserting friction rock stabilizers in earth bores, comprising:

a rigid, elongate body of a given length, and of straight configuration from end to end thereof;

means at one end of said body, having a length of less than said given length, and having a directly-engaged mechanical connection with said body, for engaging an end of a friction rock stabilizer; and means at the opposite end of said body, having a length of less than said given length, and also having a directly-engaged mechanical connection with said body, for receiving a friction rock stabilizer insertion tool, whereby upon any insertion forces being addressed to said receiving means, such forces are directly communicated to said body and, therethrough directly to said engaging means; and wherein said body and said receiving means have centerline axes which define an acute angle therebetween; and said engaging means comprises means fixed at said one end of said body which defines a land (1) for engaging an end of a friction rock stabilizer, and (2) for disposing a stabilizer, upon such being engaged with said land, at an angular inclination relative to said axis of said body.

2. An offset driver accessory, according to claim 1, wherein:

said axis of said receiving means traverses said axis of said body adjacent said opposite end of said body.

3. An offset driver accessory, according to claim 2, wherein:

said engaging means has a centerline axis which lies transverse to said axes of said body and said receiving means.

4. An offset driver accessory, according to claim 1, wherein:

said body comprises means for providing lateral, contacting support to a friction rock stabilizer upon such being engaged with said engaging means thereof.

5. An offset driver accessory, according to claim 4, wherein:

said support-providing means comprises means defining a bearing surface, formed on said body, for contacting reception of at least one side of a friction rock stabilizer.

* * * * *